US008397531B2

(12) United States Patent
Rockwell

(10) Patent No.: US 8,397,531 B2
(45) Date of Patent: Mar. 19, 2013

(54) APPARATUS AND METHOD FOR PULSATION AND SOUND REDUCTION IN AN ECONOMIZED REFRIGERATION SYSTEM

(75) Inventor: David M. Rockwell, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 1012 days.

(21) Appl. No.: 12/377,275

(22) PCT Filed: Oct. 11, 2006

(86) PCT No.: PCT/US2006/040098

§ 371 (c)(1),
(2), (4) Date: Feb. 12, 2009

(87) PCT Pub. No.: WO2008/045084

PCT Pub. Date: Apr. 17, 2008

(65) Prior Publication Data

US 2010/0218536 A1 Sep. 2, 2010

(51) Int. Cl.

| | |
|---|---|
| ***F25D 19/00*** | (2006.01) |
| ***F01N 5/00*** | (2006.01) |
| ***F01N 13/10*** | (2006.01) |
| ***G01K 11/00*** | (2006.01) |

(52) U.S. Cl. ..... 62/296; 181/212; 181/240

(58) Field of Classification Search ..... 62/5, 6, 62/296; 181/212, 213, 214, 215, 216, 224, 181/238, 239, 240

See application file for complete search history.

(56) References Cited

U.S. PATENT DOCUMENTS

| | | | | |
|---|---|---|---|---|
| 4,231,228 | A * | 11/1980 | Galvin et al. | 62/296 |
| 4,745,777 | A | 5/1988 | Morishita et al. | |
| 5,579,399 | A * | 11/1996 | Lucas | 62/6 |
| 6,042,344 | A | 3/2000 | Lifson | |
| 6,446,454 | B1 * | 9/2002 | Lee et al. | 62/296 |
| 6,453,695 | B1 * | 9/2002 | Marks et al. | 62/296 |
| 7,017,707 | B2 | 3/2006 | Zia et al. | |
| 7,055,484 | B2 * | 6/2006 | Marks et al. | 181/214 |
| 7,096,681 | B2 | 8/2006 | Wills et al. | |
| 7,156,624 | B2 | 1/2007 | Shoulders | |
| 8,276,398 | B2 * | 10/2012 | Grabon et al. | 62/296 |

OTHER PUBLICATIONS

Chinese Office Action for CN Patent Application No. 200680056042.0, dated Aug. 9, 2010.

* cited by examiner

*Primary Examiner* — Ljiljana Ciric
(74) *Attorney, Agent, or Firm* — Bachman & LaPointe, P.C.

(57) ABSTRACT

A compressor has a suction port, a discharge port, and an economizer port. A condenser is downstream of the discharge port. An evaporator is upstream of the suction port. An expansion device is between the condenser and the evaporator. An economizer is between the condenser and the evaporator. An economizer line extends from the economizer to the economizer port. A resonator is located in the economizer line and has a first branch and a second branch. A first flowpath length across the resonator through the second branch is longer than a second flowpath length across the resonator through the first branch.

21 Claims, 1 Drawing Sheet

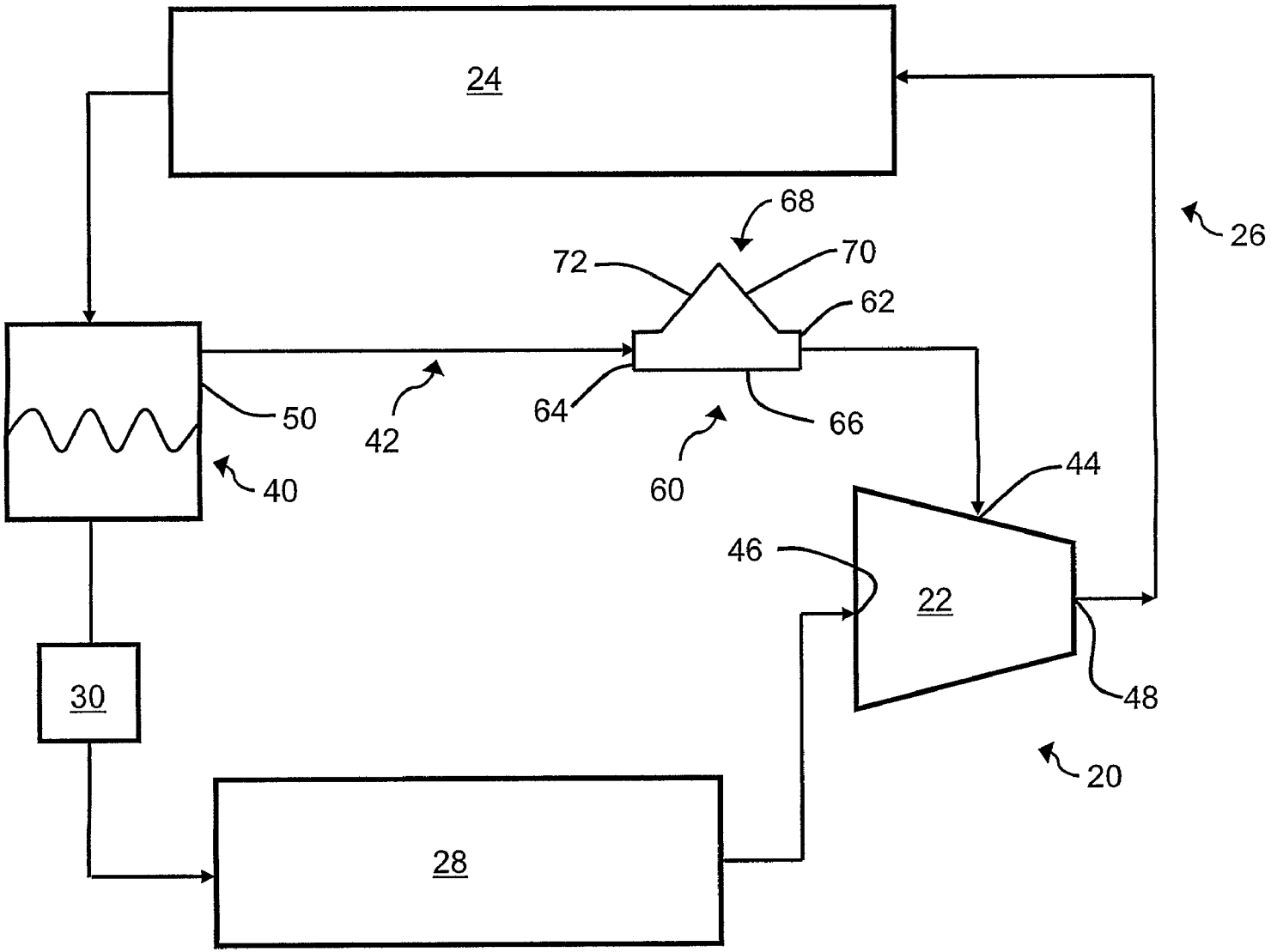
26
24
68
70
72
62
66
64
60
42
50
40
44
48
46
22
20
30
28

APPARATUS AND METHOD FOR PULSATION AND SOUND REDUCTION IN AN ECONOMIZED REFRIGERATION SYSTEM

BACKGROUND OF THE INVENTION

The invention relates to refrigeration systems. More particularly, the invention relates to sound control for economized refrigeration systems.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

Often, an absorptive muffler is located downstream of the compressor's working elements to dissipate downstream propagation of vibrations. Exemplary mufflers may be housed within a housing structure of the compressor. Additionally, in economized compressors, an absorptive muffler may be located inline in the economizer line to dissipate upstream propagation along the economizer line.

SUMMARY OF THE INVENTION

Accordingly, one aspect of the invention involves a compressor having a suction port, a discharge port, and an economizer port. A condenser is downstream of the discharge port. An evaporator is upstream of the suction port. An expansion device is between the condenser and the evaporator. An economizer is between the condenser and the evaporator. An economizer line extends from the economizer to the economizer port. A resonator is located in the economizer line and has a first branch and a second branch. A first flowpath length across the resonator through the second branch is longer than a second flowpath length across the resonator through the first branch.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 1 is a schematic view of an economized refrigeration system.

Like reference numbers and designations in the various drawings indicate like elements.

DETAILED DESCRIPTION

FIG. 1 shows a refrigeration system 20 having a compressor 22 (e.g., an electric screw compressor). A condenser 24 is downstream of the compressor 22 along a primary flowpath 26 (e.g., defined by associated refrigerant conduits/lines). An evaporator 28 is downstream of the condenser 24 and upstream of the compressor 22 along the primary flowpath 26. An expansion device 30 (e.g., an electronic expansion valve or fixed orifice) is downstream of the condenser 24 and upstream of the evaporator 28.

In the exemplary economized system, an economizer 40 is between the condenser and evaporator 28 along the flowpath 26 and, more narrowly, between the condenser 24 and expansion device 30. An economizer line 42 extends from the economizer 40 to an economizer port 44 on the compressor intermediate a suction (inlet) port 46 and a discharge (outlet) port 48. In operation, the compressor 22 drives refrigerant in a downstream direction along the primary flowpath 26. An economizer flow portion may be diverted at the economizer to pass through the economizer line 42 and return to the economizer port 44. As so-far described, the system is schematic and exemplary. Other components (e.g., fans, valves controlling refrigerant flow, and the like and a control system controlling their operation) as well as other details may be present.

In operation, pressure pulsations from the compressor 22 may pass counterflow through the refrigerant flowing in the economizer line. When these pulsations reach the vessel 50 of the economizer 40, the vessel 50 may resonate, emitting undesirable sound. Among prior art solutions is the use of an absorptive muffler in the economizer line. FIG. 1, however, shows an implementation wherein an absorptive muffler has been replaced by a dual path resonator (e.g., a Herschel-Quincke resonator) 60. The exemplary resonator includes first and second manifolds 62 and 64. A first flowpath segment/section/branch 66 extends straight between the manifolds. A second flowpath segment/section/branch 68 has first and second legs 70 and 72 at an angle to each other. The result is that the flowpath length through the second section 68 is longer than the flowpath length through the first section. In an exemplary implementation, the length difference is one half of the wavelength of a target pressure pulsation (e.g., associated with a target operating speed of the compressor and associated refrigerant flow conditions through the economizer line). Thus, pulsations in the refrigerant flowing along the two sections 66 and 68 will be out of phase upon reaching the second manifold 64 and will cancel so that less pulsation is transmitted to the housing 50. The exemplary first and second segments have essentially identical effective cross-sectional areas (e.g., to pass identical mass flows). An exemplary length difference is 0.1-1.0 m, more narrowly 0.2-0.4 m.

Although the second section 68 is shown with straight segment legs 70 and 72 at an angle to each other, other relative shapes of the two sections 66 and 68 are possible. Although shown replacing an absorptive muffler, the resonator may complement an absorptive muffler.

The resonator may be supplied in a reengineering of an existing system configuration or in a remanufacturing of an existing system. The resonator geometry may be tuned to provide the desired absorption. The tuning may be based solely upon calculation. Alternatively, the tuning may further reflect an iterative optimization performed on actual hardware or on a computer simulation. The optimization may involve selecting an initial resonator geometry and determining (e.g., measuring) an associated output sound parameter. This may be followed by modifying the geometry and redetermining the parameter until there is convergence or other indication of desired result.

One or more embodiments of the present invention have been described. Nevertheless, it will be understood that various modifications may be made without departing from the spirit and scope of the invention. For example, when applied as a modification of an existing system, details of the existing system may implement details of the particular implementation. Accordingly, other embodiments are within the scope of the following claims.

What is claimed is:

1. An apparatus comprising:

a compressor (22) having a suction port (46), a discharge port (48), and an economizer port (44);

a condenser (24) downstream of the discharge port;

an evaporator (28) upstream of the suction port;

an expansion device (30) between the condenser and the evaporator; and an economizer (40) between the condenser and the evaporator, an economizer line (42) extending from the economizer to the economizer port, wherein:

a resonator (60) is located in the economizer line and has a first branch (66) and a second branch (68), a first flowpath length across the resonator through the second branch being longer than a second flowpath length across the resonator through the first branch.

2. The apparatus of claim 1 wherein:

the first branch is straight; and the second branch has first (70) and second (72) nonparallel legs.

3. The apparatus of claim 1 wherein:

the first and second branches have essentially identical effective cross-sectional areas.

4. The apparatus of claim 1 wherein:

the compressor is an electric screw compressor.

5. The apparatus of claim 1 wherein:

the first flowpath length is longer than the second flowpath length by 0.2 m to 0.4 m.

6. The apparatus of claim 1 wherein:

there is no absorptive muffler along the economizer line.

7. An apparatus comprising:

a compressor (22) having a suction port (46), a discharge port (48), and an economizer port (44);

a condenser (24) downstream of the discharge port;

an evaporator (28) upstream of the suction port;

an expansion device (30) between the condenser and the evaporator; and an economizer (40) between the condenser and the evaporator, an economizer line (42) extending from the economizer to the economizer port, wherein:

means (60) for wave-canceling vibrations propagating along the economizer line are located in the economizer line.

8. The apparatus of claim 7 wherein:

the means comprises a Herschel-Quincke resonator.

9. The apparatus of claim 7 wherein:

the means comprises first and second flowpaths along the economizer line, the first flowpath being longer than the second flowpath by 0.2 m to 0.4 m.

10. The apparatus of claim 9 wherein:

the first and second flowpaths have essentially identical effective cross-sectional areas.

11. The apparatus of claim 9 wherein:

there is no absorptive muffler along the economizer line.

12. The apparatus of claim 7 wherein:

the means consists essentially of a Herschel-Quincke resonator.

13. The apparatus of claim 7 wherein:

there is no absorptive muffler along the economizer line.

14. A method for remanufacturing a refrigeration system (20) or reengineering a configuration of a refrigeration system, comprising:

placing a resonator (60) in an economizer line (42) so as to divide a flowpath through the line into first and second fluidically parallel sections, the second section being longer than the first section.

15. The method of claim 14 wherein:

the resonator replaces an absorptive muffler.

16. The method of claim 14 further comprising:

selecting a difference in flowpath length through the first and second sections to provide a pulsation cancellation.

17. The method of claim 14 wherein:

the selecting comprises an iterative process of varying the difference and determining an associated sound level.

18. The method of claim 14 wherein:

the second section is 0.2 m to 0.4 m longer than the first section.

19. The method of claim 14 wherein:

the first and second sections have essentially identical effective cross-sectional areas.

20. The method of claim 14 wherein the system has:

a compressor having a suction port, a discharge port, and an intermediate economizer port;

a condenser downstream of the discharge port;

an evaporator upstream of the suction port;

an expansion device between the condenser and the evaporator; and an economizer between the condenser and the evaporator, said economizer line extending from the economizer to the economizer port.

21. An apparatus positioned along an economizer line located in a refrigeration system, wherein the apparatus reduces vibrations within the system, the apparatus comprising:

a first manifold configured to be in fluid connection to an economizer vessel;

a second manifold configured to be in fluid connection with a compressor;

a first flowpath that is substantially straight and extends between the first and second manifold;

a second flowpath that extends between the first and second manifold, wherein the second flowpath is of a different length than the first flowpath such that any pulsations traveling through the first and second flowpaths are out of phase with one another upon reaching the second manifold.

* * * * *